US006656881B2

(12) United States Patent
Shirai et al.

(10) Patent No.: US 6,656,881 B2
(45) Date of Patent: Dec. 2, 2003

(54) THERMAL TRANSFER IMAGE-RECEIVING SHEET

(75) Inventors: Koichi Shirai, Tokyo-To (JP); Tadahiro Ishida, Tokyo-To (JP); Katsuyuki Oshima, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/842,196

(22) Filed: Apr. 26, 2001

(65) Prior Publication Data

US 2002/0041951 A1 Apr. 11, 2002

(30) Foreign Application Priority Data

Apr. 27, 2000 (JP) ..... 2000-127102

(51) Int. Cl.[7] ..... B41M 5/30; B41M 5/035; B41M 5/38

(52) U.S. Cl. ..... 503/227; 428/32.39

(58) Field of Search ..... 8/471; 428/195, 428/913, 914, 32.39; 427/152; 503/227

(56) References Cited

U.S. PATENT DOCUMENTS 6,365,546 B1 * 4/2002 Kometani ..... 503/227

* cited by examiner

*Primary Examiner*—B. Hamilton Hess

(74) *Attorney, Agent, or Firm*—Parkhurst & Wendel, L.P.P.

(57) ABSTRACT

The present invention is directed to the provision of a thermal transfer image-receiving sheet which, even when used with various printers, can be carried with improved accuracy, can form color images without misregistration, and does not permit traces of spikes to reach an image-receiving face and, thus, can minimize the influence of spikes on the quality of images. In a thermal transfer image-receiving sheet 10 comprising a colorant-receptive layer 2 provided on a substrate 1, the substrate 1 is formed of a laminate comprising a plastic film 3 having in its inside microvoids, a support 4, and a backside film 5 provided in that order from the colorant-receptive layer 2 side and the backside film 5 is an unstretched polyolefin film. By virtue of this construction, a thermal transfer image-receiving sheet can be realized which, even when used with printers, can be carried with improved accuracy, can form color images without misregistration, and does not permit traces of spikes to reach an image-receiving face and, thus, can minimize the influence of spikes on the quality of images.

4 Claims, 1 Drawing Sheet

THERMAL TRANSFER IMAGE-RECEIVING SHEET

TECHNICAL FIELD

The present invention relates to a thermal transfer image-receiving sheet, and more particularly to a thermal transfer image-receiving sheet that can prevent misregistration which is likely to take place in the formation of a color image on the thermal transfer image-receiving sheet.

BACKGROUND OF THE INVENTION

In a conventional method for the formation of a color image on a thermal transfer image-receiving sheet, a thermal transfer sheet, comprising colorant layers of three colors of yellow, magenta, and cyan or optionally four colors of yellow, magenta, cyan, and black provided in a face serial manner, and a thermal transfer image-receiving sheet optionally provided with a colorant-receptive layer are first passed through between a heating device and a platen roller pushed by a certain pressure. At that time, a heating device in its heating portion is selectively heated according to image information to allow the colorant contained in the colorant layer in the thermal transfer sheet to migrate into the colorant-receptive layer in the thermal transfer image-receiving sheet to form an image. In the thermal transfer sheet, colorant layers of three colors or four colors are provided in a face serial manner, and different colors are successively transferred three times or four times color by color onto an identical position of the thermal transfer image-receiving sheet to superimpose colors on top of one another to form a color image. In particular, sublimation dye thermal transfer (sublimation-type thermal transfer) is superior to ink melt thermal transfer (hot melt-type thermal transfer) in higher resolution and multi-gradation expression, and is used in applications where high image quality is required.

One method for forming this type of color image is to superimpose individual colors on top of one another in a face serial manner. In this method, since color images are formed screen by screen, while reciprocating the thermal transfer image-receiving sheet, an image is transferred color by color from the thermal transfer sheet successively wound in one direction to superimpose the colors on top of each other or one another. This method is advantageous in that the printing speed is high and, unlike a serial method, there is no overlap between lines. Therefore, if the positional accuracy is high, then high-quality images could be formed. In this method, however, since the thermal transfer image-receiving sheet is reciprocated, the positioning accuracy of the sheet is low. Therefore, the so-called "misregistration" is likely to occur. Further, for example, it is difficult to realize a reduction in size and weight and a reduction in cost of printers used for this method.

The following several types of printers for this method have hitherto been proposed.

For example, a printer, wherein a thermal transfer image-receiving sheet is reciprocated in such a state that one end of the thermal transfer image-receiving sheet is held by a chuck, has excellent carrying accuracy because the reciprocation is performed by an independent chuck. In this printer, however, although images can be easily printed, for example, on thermal transfer image-receiving sheets of relatively large size, i.e., size A3 or larger size, the mechanism is complicate and the device is large. Further, images cannot be printed on thermal transfer image-receiving sheets of small size without difficulties, and, in addition, the device is expensive. A printer, wherein one end of a thermal transfer image-receiving sheet is fixed and wound on a chuck provided on the surface of a platen roller and the thermal transfer image-receiving sheet is reciprocated by the rotation of the platen roller, has a problem, before the discussion of carrying accuracy, that paper jams are likely to occur at the time of discharge of the thermal transfer image-receiving sheet.

On the other hand, a printer, wherein a thermal transfer image-receiving sheet is held by a grip roller composed of a rubber roller and a metallic roller and is reciprocated by the rotation of the grip roller, is currently most extensively used because, due to simple structure, the size can be reduced and the device is inexpensive. In this printer, the grip roller is composed of a rubber roller for preventing the slip of the sheet and a metallic roller which has on its surface fine projections (hereinafter referred to as "spikes") with a height of about 40 to 100 $\mu$m formed by etching, and carries, with high accuracy, the thermal transfer image-receiving sheet while allowing the spikes to bite into the thermal transfer image-receiving sheet. This grip roller has originally been mainly used in single color printing devices, for example, diazo copy of drawings or printers for drafting where the reciprocation of the thermal transfer image-receiving sheet is not required. Therefore, the carrying accuracy of printers using the grip roller is not very good, and the reciprocation of the thermal transfer image-receiving sheet to print an image is likely to cause misregistration. The carrying accuracy at the time of reciprocation can be improved by increasing the pressure for pushing the rubber roller and the metallic roller. In this case, however, the spikes of the metallic roller excessively bite into the thermal transfer image-receiving sheet to leave traces of the spikes. In particular, in the case of thin thermal transfer image-receiving sheets, the traces of spikes become a serious problem, and, in some cases, the traces of spikes reach the image-receiving face in the surface of the thermal transfer image-receiving sheet, leading to lowered quality of color prints.

In order to solve the above problem, thermal transfer image-receiving sheets respectively compatible with various types of printers have hitherto been supplied, for example, in consideration of properties of commercially available printers, for example, carrying accuracy of printers, pushing pressure of the grip roller for improving the carrying accuracy, and the level of traces of spikes caused by increasing the pushing pressure of the grip roller. For example, in order to improve the carrying accuracy, the thickness of the thermal transfer image-receiving sheet has been increased so that, even when the pushing pressure of the grip roller is increased, the influence of the spikes does not reach the image-receiving face.

Supplying thermal transfer image-receiving sheets of a wide variety of specifications, which have been rendered respectively compatible with various printers, however, significantly increases development cost and production cost. When the thickness of the thermal transfer image-receiving sheet is increased from the viewpoint of reducing the influence of the spikes, the thickness and layer construction regarded as suitable for conventional thermal transfer image-receiving sheets are limited and this often limits functions usually possessed by the thermal transfer image-receiving sheets, for example, handle, nerve, gloss and other properties.

DISCLOSURE OF THE INVENTION

The present invention is directed to a solution of the problems of the prior art, and it is an object of the present invention to provide a thermal transfer image-receiving sheet which, even when used with various printers, can be carried with improved accuracy, can form color images without misregistration, and does not permit traces of spikes to reach an image-receiving face and, thus, can minimize the influence of spikes on the quality of images.

The above object of the present invention can be attained by a thermal transfer image-receiving sheet comprising:

a substrate; and a colorant-receptive layer provided on the substrate, said substrate being formed of a laminate comprising a plastic film having in its inside microvoids, a support, and a backside film provided in that order from the side of the interface with the colorant-receptive layer, said backside film being an unstretched polyolefin film.

By virtue of the above construction, the thermal transfer image-receiving sheet according to the present invention can be carried in printers with improved accuracy, can form color images without misregistration, and does not permit traces of spikes to reach an image-receiving face and, thus, can minimize the influence of spikes on the quality of images.

According to the present invention, the backside film preferably has a thickness of 12 to 40 $\mu$m.

Further, the backside film is preferably formed of straight-chain low-density polyethylene.

Preferably, a polyolefin layer having a thickness of not less than 10 $\mu$m is provided between the support and the backside film.

BEST MODE FOR CARRYING OUT THE INVENTION

The present invention will be described in more detail with reference to the following embodiments.

Figure 1:
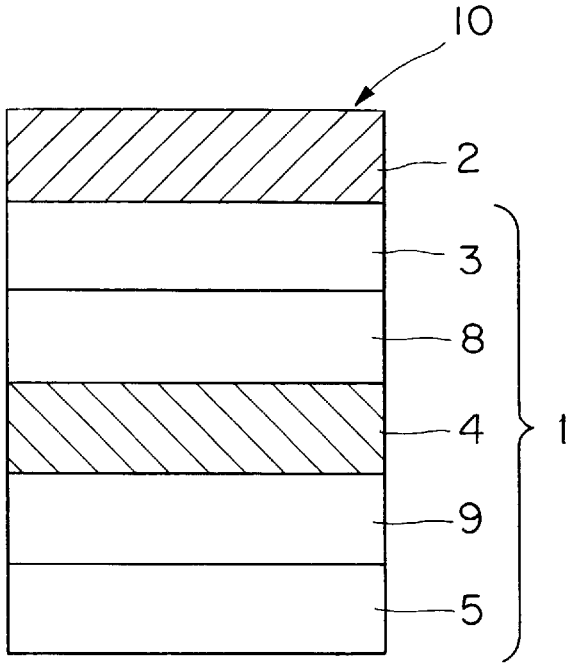
FIG. 1 is a cross-sectional view showing one embodiment of the thermal transfer image-receiving sheet according to the present invention.

FIG. 1 is a cross-sectional view of a thermal transfer image-receiving sheet 10 which is one embodiment of the thermal transfer image-receiving sheet according to the present invention. The thermal transfer image-receiving sheet 10 comprises: a substrate 1; and a colorant-receptive layer 2 provided on the substrate 1. The substrate 1 comprises a plastic film 3 having in its inside microvoids, an adhesive layer 8, a support 4, an adhesive layer 9, and a backside film 5 provided in that order from the colorant-receptive layer 2 side. The backside film 5 is an unstretched polyolefin film.

Figure 2:
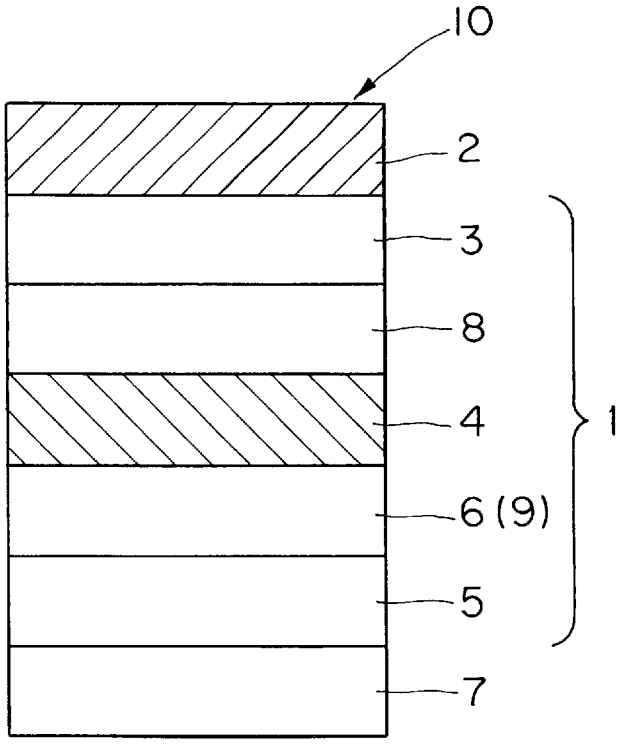
FIG. 2 is a cross-sectional view showing another embodiment of the thermal transfer image-receiving sheet according to the present invention.

FIG. 2 is a cross-sectional view of a thermal transfer image-receiving sheet 10 which is another embodiment of the thermal transfer image-receiving sheet according to the present invention. The thermal transfer image-receiving sheet 10 comprises: a substrate 1; and a colorant-receptive layer 2 provided on the substrate 1. The substrate 1 comprises a plastic film 3 having in its inside microvoids, an adhesive layer 8, a support 4, a polyolefin layer 6 (an adhesive layer 9), and a backside film 5 provided in that order from the colorant-receptive layer 2 side. Further, a backside layer 7 is provided on the surface of the backside film 5.

In FIG. 2, the polyolefin layer 6 serves both as a support and an adhesive layer for bonding the backside film. In this connection, it should be noted that a construction may also be adopted wherein a polyolefin layer and an adhesive layer are provided separately from each other, that is, a layer construction of plastic film/adhesive layer/support/adhesive layer/polyolefin layer/backside film may also be adopted.

Individual layers constituting the thermal transfer image-receiving sheet according to the present invention will be described.

[Support]

The support 4 may have a single layer structure or may be a composite film of two or more layers stacked on top of each other or one another through an adhesive layer or without interposing any adhesive layer between the two or more layers, and examples of materials usable for constituting the support 4 include polyolefin films, such as polyethylene film and polypropylene film, and polyester films, such as polyethylene terephthalate (hereinafter referred to as "PET") films. Other materials usable for constituting the support 4 include resin films, such as rigid vinyl chloride, acrylic, and vinylidene chloride resins, and plain papers, synthetic papers, or cellulose papers. Among them, cellulose papers are successfully bitten by spikes and thus are preferred. Examples of cellulose papers include wood-free papers, coated papers, art papers, cast coated paper, and converted papers with a synthetic resin or rubber being impregnated thereinto, coated thereon, or internally added thereto.

The thickness of the support 4 is generally about 35 to 100 $\mu$m, for example, in consideration of the strength and the influence of the thickness on the thickness of the whole thermal transfer image-receiving sheet.

[Plastic Film Having in its Inside Microvoids]

A plastic sheet or synthetic paper having in its inside microvoids may be used as the plastic film 3 having in its inside microvoids. The plastic sheet or synthetic paper having in its inside microvoids is preferably a plastic sheet or synthetic paper prepared by blending a polyolefin, particularly polypropylene, with an inorganic pigment and/or a polymer incompatible with polypropylene as a void preparation initiator to prepare a mixture composed mainly of the polyolefin, particularly polypropylene, and containing the void preparation initiator and then subjecting the mixture to stretching and film formation. When the plastic sheet or synthetic paper is composed mainly of a polyester or the like, due to its viscoelastic or thermal properties, the cushioning properties and insulating properties are inferior to those of the plastic sheet or synthetic paper composed mainly of polypropylene. Therefore, in this case, sensitivity in printing is inferior and, in addition, uneven density and the like are likely to occur.

When these are taken into consideration, the modulus of elasticity of the plastic sheet and synthetic paper at 20° C. is preferably $5\times10^8$ Pa to $1\times10^{10}$ Pa.

Further, the plastic sheet or synthetic paper is generally one which has been formed by biaxial stretching. Therefore, this plastic sheet or synthetic paper shrinks upon heating. When the plastic sheet or synthetic paper is allowed to stand at 110° C. for 60 sec, the shrinkage is 0.5 to 2.5%. The plastic sheet or synthetic paper may have a single layer structure of a layer which per se has microvoids, or alternatively may have a multi-layer structure of a plurality of layers. In the case of the multi-layer structure, all the layers constituting the multi-layer structure may contain microvoids, or alternatively a layer free from microvoids may exist. If necessary, a white pigment may be incorporated as a masking agent into the plastic sheet or the synthetic paper. Further, fluorescent brighteners or other additives may be added to enhance the whiteness.

The thickness of the plastic film having in its inside microvoids is preferably about 50 to 150 μm.

Methods usable for the lamination of the film having in its inside microvoids onto the support include, for example, conventional lamination methods wherein bonding is carried out through an adhesive layer 8, 9, such as dry lamination, nonsolvent (hot-melt) lamination, and EC lamination. Preferred are dry lamination and nonsolvent lamination.

The adhesive used in this lamination may be composed of a polyacrylic ester, an acrylic copolymer or the like, and, if necessary, reinforcements, plasticizers, fillers and the like may be added thereto.

Adhesives suitable for nonsolvent lamination include, for example, Takenate A-720L manufactured by Takeda Chemical Industries, Ltd., and adhesives suitable for dry lamination include, for example, Takelac A 969/Takenate A-5 (3/1) manufactured by Takeda Chemical Industries, Ltd. The amount of each of these adhesives used is in the range of about 1 to 8 g/m$^2$, preferably in the range of 2 to 6 g/m$^2$, on a solid basis.

The film having in its inside microvoids may also be formed, as a layer having microvoids, on the support by various coating methods. Plastic resins usable herein include conventional resins, such as polyester, urethane resins, polycarbonate, acrylic resins, polyvinyl chloride, and polyvinyl acetate. They may be used alone or as a blend of two or more of them.

Likewise, the lamination may be performed by the lamination of the support to the backside film.

[Backside Film]

A backside film 5 is located on the backside of the thermal transfer image-receiving sheet, and, when the thermal transfer image-receiving sheet is carried by means of a printer, comes into contact with a grip roller. In the present invention, the backside film is an unstretched polyolefin film which can prevent slippage between the thermal transfer image-receiving sheet and the metallic roller. By virtue of this, at the time of the reciprocation for color image formation, the carrying accuracy of the thermal transfer image-receiving sheet can be improved, and a color image can be formed without misregistration.

The unstretched polyolefin film preferably has a softening point of 110° C. or above, is bitten to a suitable extent by the spikes of the metallic roller, and, thus, can prevent slippage between the metallic roller and the thermal transfer image-receiving sheet.

A stretched synthetic resin layer has a high Young's modulus, and is excessively hard. Therefore, the stretched synthetic resin layer is unsatisfactorily bitten by the spikes. For this reason, when a stretched film is used as the backside film, slippage occurs between the metallic roller and the thermal transfer image-receiving sheet at the time of reciprocation for color image formation. This lowers the carrying accuracy and causes misregistration. On the other hand, films having an excessively low softening point have wax-like properties, are brittle and have low strength, and, thus, at the time of reciprocation, are excessively bitten by the spikes and are often deformed or cause other unfavorable phenomena.

The unstretched polyolefin film having a softening point of 110° C. or above is particularly preferably an unstretched polypropylene film which is satisfactorily bitten by the spikes. Further, polyolefin films are low in material cost and thus are also advantageous in cost.

Among the unstretched polyolefin films, low-density polyethylene films are particularly preferred as the backside film, because the low-density polyethylene film, when stacked onto the plastic film having in its inside microvoids through the support as a core material, can offer proper curl balance and proper rigidity as a substrate. Since the low-density polyethylene film has a suitable level of Young's modulus and suitable hardness, the low-density polyethylene film is bitten to a proper extent by the spikes and thus does not cause slippage between the thermal transfer image-receiving sheet and the metallic roller at the time of the rotation of the metallic roller. Further, unlike wax, the low-density polyethylene film is not brittle, and, thus, there is no fear of the backside film being broken by excessive biting by the spikes.

The thickness of the backside film is preferably 12 to 40 μm. When the thickness is less than 12 μm, the spike unsatisfactorily bites into the backside film and, thus, slippage takes place between the metallic roller and the thermal transfer image-receiving sheet at the time of reciprocation for color image formation. This lowers the carrying accuracy and leads to a fear of causing misregistration. On the other hand, a thickness exceeding 40 μm is unnecessarily large thickness for the backside film which increases the cost. Further, from the viewpoints of carriability within a printer and handling, the thermal transfer image-receiving sheet is often required to be thin, and, when the thickness of the backside film exceeds 40 μm, the thickness of the whole thermal transfer image-receiving sheet becomes large, often making it impossible to meet the requirement. For reasons including this, the thickness of the backside film is limited to 12 to 40 μm.

In the substrate, a polyolefin layer 6 having a thickness of not less than 10 μm is preferably interposed between the backside film and the support. In this case, a method may be used wherein two layers of the unstretched polyolefin film as the backside film and the polyolefin layer having a thickness of not less than 10 μm are simultaneously coextrusion coated and stacked. Further, a preferred method is to apply the backside film to the support through the polyolefin layer having a thickness of not less than 10 μm as an adhesive layer.

Methods usable for forming the backside film on the support include a method wherein an unstretched polyolefin resin layer, which has been previously formed in a film form, is laminated onto the support, a method wherein a coating liquid is prepared and coated, and a method wherein extrusion lamination is carried out.

Among these methods, the extrusion lamination is preferred, because a synthetic resin layer in an unstretched state can be easily formed, and, in addition, the process has been already established, and the extrusion lamination is also advantageous in cost. In the case of the coating method, since a lot of time is necessary for drying after coating, the line speed is lowered, and the productivity is slightly inferior to the extrusion lamination. The coating method, however, is preferred from the practical viewpoint. When the method, wherein the backside film is laminated, is carried out in combination with the lamination of the plastic film having in its inside microvoids onto the support in its image-receiving face side, a substrate, which undergoes no significant curl deformation and is flat, can be easily prepared, and, thus, this combination is most preferred from the practical viewpoint.

The thickness of the whole thermal transfer image-receiving sheet should be about 150 to 250 μm, for example, from the viewpoint of carriability within printers. In the layer construction of plastic film having in its inside microvoids/support/backside film wherein an adhesive layer for lamination may be provided on the surface of the support and on the backside, the thickness of each of the plastic film having in its inside microvoids, the support, and the backside film is regulated to regulate the thickness of the whole substrate and to provide rigidity as the substrate, thereby preparing a substrate which has reduced curling properties and is flat.

[Colorant-receptive Layer]

According to the present invention, the colorant-receptive layer 2 is provided on one side of the substrate, and functions to receive a sublimation dye being transferred from a thermal transfer sheet and to hold the formed thermal transferred image thereon. Thermoplastic resins usable as binder resins for the colorant-receptive layer include, for example, halogenated polymers, such as polyvinyl chloride and polyvinylidene chloride, vinyl resins, such as polyvinyl acetate, ethylene-vinyl acetate copolymers, vinyl chloride-vinyl acetate copolymers, polyacrylic esters, polystyrene, and polystyrene-acryl, acetal resins, such as polyvinyl formal, polyvinyl butyral, and polyvinyl acetal, various saturated and unsaturated polyester resins, polycarbonate resins, cellulosic resins, such as cellulose acetate, polyolefin resins, and polyamide resins, such as urea resins, melamine resins, and benzoguanamine resins. These resins may be used alone or as a blend of two or more of them at any ratio such that the resins remain compatible with each other.

In order to prevent heat blocking between the colorant-receptive layer 2 and the thermal transfer sheet, if necessary, preferably, a release agent is thinly coated onto the colorant-receptive layer to form a release layer, or alternatively, a release agent is incorporated into the colorant-receptive layer.

The release agent is preferably a silicone oil which can bleed from the inside of the receptive layer onto the surface of the receptive layer to easily form a release layer on the surface of the receptive layer. Preferred silicone oils include modified silicone oils, for example, phenyl-modified, carbinol-modified, amino-modified, alkyl-modified, epoxy-modified, carboxyl-modified, alcohol-modified, fluorine-modified, alkylaralkyl polyether-modified, epoxy-polyether-modified, and polyether-modified silicone oils.

In particular, modified silicone oils represented by the following chemical formula have excellent separability from the dye layer and thus are preferred.

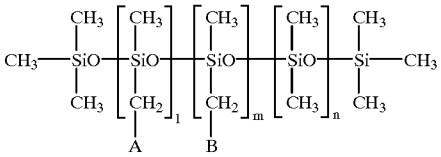

wherein A represents an aryl group, such as a phenyl group; B represents an epoxy-modified alkyl chain; and 1, m, and n each are an integer of 1 or more.

Further, a reaction cured product of a plurality of modified silicone oils, such as a reaction product between a vinyl-modified silicone oil and a hydrogen-modified silicone oil and a reaction cured product between an amino-modified silicone oil and an epoxy-modified silicone oil, and a reaction cured product between a modified silicone oil having active hydrogen and a curing agent reactive with active hydrogen may also be used.

The amount of the release agent added is preferably 0.5 to 10% by mass based on the solid basis of the receptive layer.

In addition to the release agent, various other optional additives may be added to the receptive layer. Pigments or fillers, such as titanium oxide, zinc oxide, kaolin, clay, calcium carbonate, and finely divided silica, may be added to improve the whiteness of the receptive layer and thus to further enhance the sharpness of transferred images. Further, conventional additives, such as plasticizers, ultraviolet absorbers, photostabilizers, antioxidants, fluorescent brighteners, and antistatic agents, may be optionally added to the receptive layer.

The resin, the release agent, the optional additive and the like are satisfactorily mixed and kneaded with one another in a solvent, a diluent or the like to prepare a coating liquid for a receptive layer. The coating liquid is then coated on the substrate by receptive layer formation means, for example, gravure printing, screen printing, reverse roll coating using a gravure plate, and the coating is dried to form a receptive layer. An intermediate layer, a backside layer and the like, which will be described later, may be formed in the same coating method as used as the receptive layer formation means. In order to impart antistatic properties, an antistatic agent may be incorporated into the coating liquid for a receptive layer. Examples of antistatic agents usable herein include fatty esters, sulfuric esters, phosphoric esters, amides, quaternary ammonium salts, betaines, amino acids, arcylic resins, and ethylene oxide adducts. The amount of the antistatic agent added is preferably 0.1 to 2.0% by mass based on the resin.

In the thermal transfer image-receiving sheet according to the present invention, the coverage of the colorant-receptive layer is preferably 0.5 to 4.0 g/m$^2$ on a dry mass basis. A coverage of less than 0.5 g/m$^2$ on a dry mass basis poses a problem that, for example, when the colorant-receptive layer is provided directly on the substrate, an image in its high-light portion is rough because the adhesion between the colorant-receptive layer and a thermal head is unsatisfactory, for example, due to rigidity of the substrate. This problem can be solved by providing an intermediate layer for imparting cushioning properties. The provision of the intermediate layer, however, lowers scratch resistance of the colorant-receptive layer. Further, there is a tendency such that the level of roughening of the surface upon the application of high energy relatively increases with increasing the coverage of the colorant-receptive layer. For this reason, the upper limit of the coverage is preferably 4.0 g/m$^2$ on a dry mass basis. In the following description in connection with the present invention, the coverage (or coating amount) is on a dry mass basis and is a numeric value in terms of solid content unless otherwise specified.

[Intermediate Layer]

The intermediate layer is not always required, and, if necessary, may be provided between the substrate 1 and the colorant-receptive layer 2 to impart various properties to the thermal transfer image-receiving sheet. For example, adhesion between layers, whiteness, cushioning properties, antistatic properties, concealing properties for obstructing an image or the like on the opposite side, and other properties can be imparted by the intermediate layer. A suitable intermediate layer may be selected from conventional intermediate layers.

The intermediate layer may be formed, for example, using a thermoplastic resin, a thermosetting resin, or a functional group-containing thermoplastic resin by using various curing agents or by other methods. Specific examples of resins usable herein include polyvinyl alcohols, polyvinyl pyrrolidones, polyesters, chlorinated polypropylenes, modified polyolefins, urethane resins, acrylic resins, polycarbonates, ionomers, and resins prepared by curing monofunctional and/or polyfunctional hydroxyl-containing prepolymers with an isocyanate or the like. If necessary, additives, such as titanium oxide, calcium carbonate, barium sulfate or other conventional inorganic pigments or organic fillers, and fluorescent brighteners, may be added to these resins to impart whiteness, concealment or other functions. The coating thickness is preferably about 0.5 to 30 $\mu$m on a dry basis.

[Backside Layer]

A backside layer 7 may be provided on the substrate in its side remote from the colorant-receptive layer, for example, from the viewpoints of improving the carriability of the thermal transfer image-receiving sheet and preventing curling. The backside layer having such functions may be formed from a composition comprising a resin, such as acrylic resin, cellulosic resin, polycarbonate resin, polyvinyl acetal resin, polyvinyl alcohol resin, polyamide resin, polystyrene resin, polyester resin, or halogenated polymer, and, added to the resin, an additive, for example, an organic filler, such as an acrylic filler, a polyamide filler, a fluorofiller, or polyethylene wax, or an inorganic filler, such as silicon dioxide or metal oxide. The use of a product, of curing of the above resin with a curing agent, as the backside layer is further preferred. The curing agent may be generally a conventional one, and, among others, the use of an isocyanate compound as the curing agent is preferred. The resin for the backside layer is reacted with an isocyanate compound or the like to form a urethane bond, whereby the resin is cured and consequently forms a three-dimensional structure. This can improve heat resistance, storage stability, and solvent resistance, and, in addition, can improve the adhesion to the substrate sheet. The amount of the curing agent added is preferably 1 to 2 per reactive group equivalent of the resin. When the amount of the curing agent added is less than 1, a lot of time is necessary for completing the curing and, in addition, the heat resistance and the solvent resistance are deteriorated. On the other hand, when the amount of the curing agent added exceeds 2, problems occur including a change in the backside layer after the film formation with the elapse of time, and a short storage life of the coating liquid for the backside layer.

An organic filler or an inorganic filler may be added as an additive to the backside layer. These fillers function to improve the carriability of the thermal transfer image-receiving sheet within printers, and, in addition, for example, to prevent blocking, that is, to improve the storage stability of the thermal transfer image-receiving sheet. Organic fillers usable herein include acrylic fillers, polyamide fillers, fluorofillers, and polyethylene wax. Among them, polyamide fillers are particularly preferred. Inorganic fillers include silicon dioxide and metal oxides. Polyamide fillers are preferably those which have a molecular weight of 100000 to 900000, are spherical, and have a average particle diameter of 0.01 to 30 $\mu$m, and particularly preferably those which have a molecular weight of 100000 to 500000 and have an average particle diameter of 0.01 to 10 $\mu$m. Regarding the type of polyamide fillers, as compared with nylon 6 and nylon 66 fillers, nylon 12 fillers have better water resistance and are free from a change in properties caused by water absorption and thus are more preferred.

The polyamide filler has a high melting point, is thermally stable, has good oil resistance and chemical resistance, and is less likely to be dyed with a dye. Further, when the polyamide filler has a molecular weight of 100000 to 900000, the polyamide filler is hardly abraded, is self-lubricative, has a low coefficient of friction, and is less likely to scratch an object rubbed against the filler. The average particle diameter is preferably 0.1 to 30 $\mu$m in the case of thermal transfer image-receiving sheets for reflection images. When the particle diameter is excessively small, the filler is concealed within the backside layer and this is likely to make it difficult to develop satisfactory slip function. On the other hand, when the particle diameter is excessively large, the level of projection from the backside layer is large. This disadvantageously enhances the coefficient of friction and causes the separation of the filler from the backside layer. The mixing ratio of the filler to the resin in the backside layer is preferably in the range of 0.01 to 200% by mass, and, in the case of thermal transfer image-receiving sheets for reflection images, is more preferably 1 to 100% by mass, and, in the case of thermal transfer image-receiving sheets for transmission images, is more preferably 0.05 to 2% by mass. When the mixing ratio of the filler is less than 0.01% by mass, the slipperiness is unsatisfactory and, consequently, a paper jam or other unfavorable phenomenon is likely to occur, for example, at the time of sheet feeding to a printer. On the other hand, when the mixing ratio of the filler exceeds 200% by mass, the slipperiness is excessively high and, disadvantageously, this is likely to cause color shift or the like in printed images.

An antistatic layer may be provided on the surface of the receptive layer or the backside, or on both sides as the outermost surface in the thermal transfer image-receiving sheet. The antistatic layer may be formed by coating a coating liquid prepared by dissolving or dispersing an antistatic agent, such as a fatty ester, a sulfuric ester, a phosphoric ester, an amide, a quaternary ammonium salt, a betaine, an amino acid, an acrylic resin, or an ethylene oxide adduct, in a solvent. The coverage of the antistatic layer is preferably 0.001 to 0.1 g/m$^2$ on a dry basis.

EXAMPLES

The following examples and comparative examples further illustrate the present invention. In the following description, "parts" or "%" is by mass.

Example 1

A primer layer (Unistole P801, manufactured by Mitsui Chemicals Inc.) was formed at a coverage of 1 g/m$^2$ on a dry basis on a 39 $\mu$m-thick polypropylene film (Toyopearl SS P 4255, manufactured by Toyobo Co., Ltd.) having in its inside microvoids. The following coating liquid for a colorant-receptive layer was coated on the primer layer at a coverage of 3 g/m$^2$ on a dry basis, and the coating was dried to form a colorant-receptive layer. The following coating liquid for an adhesive layer was then coated at a coverage of 4 g/m$^2$ on a dry basis on the polypropylene film in its side remote from the colorant-receptive layer, and the coating was dried to form an adhesive layer. The assembly was then applied to a coated paper (NK HI-KOTE, 127.9 g/m$^2$, manufactured by NIPPON KAKOH SEISHI CO., LTD.) as a support so that the adhesive layer faced the coated paper. Thereafter, the same coating liquid for an adhesive layer as used above was coated at a coverage of 4 g/m$^2$ on a dry basis on the coated paper in its side remote from the colorant-receptive layer, and the coating was dried to form an adhesive layer. The coated paper was applied through this adhesive layer to a 40 $\mu$m-thick polyethylene film (unstretched, straight-chain low-density polyethylene film L 6101, manufactured by Toyobo Co., Ltd.) as a backside film. Thus, a thermal transfer image-receiving sheet of Example 1 was produced. In this case, the 40 $\mu$m-thick polyethylene film had a backside layer which had been previously formed by coating the following coating liquid for a backside layer at a coverage of 2.5 g/m$^2$ on a dry basis on the polyethylene film in its side remote from the adhesive layer and drying the coating.

| | |
|---|---|
| (Coating liquid for colorant-receptive layer) | |
| Polyester resin (Vylon 200, manufactured by Toyobo Co., Ltd.) | 20 parts |
| Silicone oil (X-22-3000T, manufactured by The Shin-Etsu Chemical Co., Ltd) | 2 parts |
| Toluene | 39 parts |
| Methyl ethyl ketone | 39 parts |
| (Coating liquid for adhesive layer) | |
| Polyfunctional polyol (Takelac A-969 V, manufactured by Takeda Chemical Industries, Ltd.) | 30 parts |
| Isocyanate (Takenate A-5, manufactured by Takeda Chemical Industries, Ltd.) | 10 parts |
| Ethyl acetate | 60 parts |
| (Coating liquid for backside layer) | |
| Acrylic resin (BR-85, manufactured by Mitsubishi Rayon Co., Ltd.) | 10 parts |
| Teflon filler (Ruburon (Daikin Polyflon Tef Low Polymer) L-5, manufactured by Daikin Industries, Ltd.) | 0.1 part |
| Methyl ethyl ketone/toluene (mixing ratio (by mass) = 1/1) | 89.9 parts |

Example 2

The procedure of Example 1 was repeated, except that, in the preparation of the thermal transfer image-receiving sheet, the backside film of the substrate was changed to a 20 μm-thick polyethylene film (unstretched straight-chain low-density polyethylene film L 6101, manufactured by Toyobo Co., Ltd.). Thus, a thermal transfer image-receiving sheet of Example 2 was prepared.

Example 3

A primer layer (Unistole P801, manufactured by Mitsui Chemicals Inc.) was formed at a coverage of 1 g/m$^2$ on a dry basis on a 39 μm-thick polypropylene film (Toyopearl SS P 4255, manufactured by Toyobo Co., Ltd.) having in its inside microvoids. The same coating liquid for a colorant-receptive layer as used in Example 1 was coated on the primer layer at a coverage of 3 g/m$^2$ on a dry basis, and the coating was dried to form a colorant-receptive layer. The same coating liquid for an adhesive layer as used in Example 1 was then coated at a coverage of 4 g/m$^2$ on a dry basis on the polypropylene film in its side remote from the colorant-receptive layer, and the coating was dried to form an adhesive layer. The assembly was then applied to a coated paper (NK HI-KOTE, 127.9 g/m$^2$, manufactured by NIPPON KAKOH SEISHI CO., LTD.) as a support so that the adhesive layer faced the coated paper. Thereafter, a 20 μm-thick polyethylene film (unstretched, straight-chain low-density polyethylene film L 6101, manufactured by Toyobo Co., Ltd.) as a backside film was applied to the coated paper (support) on its side remote from the colorant-receptive layer through a 15 μm-thick low density polyethylene resin (LDPE) layer formed by extrusion coating of LDPE. Thus, a thermal transfer image-receiving sheet of Example 3 was produced. In this case, the 20 μm-thick polyethylene film had a backside layer which had been previously formed by coating the same coating liquid for a backside layer as used in Example 1 at a coverage of 2.5 g/m$^2$ on a dry basis on the polyethylene film in its side remote from the LDPE layer as the adhesive layer and drying the coating.

Example 4

The procedure of Example 1 was repeated, except that, in the preparation of the thermal transfer image-receiving sheet, the backside film of the substrate was changed to a 60 μm-thick polyethylene film (unstretched straight-chain low-density polyethylene film L 6101, manufactured by Toyobo Co., Ltd.). Thus, a thermal transfer image-receiving sheet of Example 4 was prepared.

Comparative Example 1

A primer layer (Unistole P801, manufactured by Mitsui Chemicals Inc.) was formed at a coverage of 1 g/m$^2$ on a dry basis on a 39 μm-thick polypropylene film (Toyopearl SS P 4255, manufactured by Toyobo Co., Ltd.) having in its inside microvoids. The same coating liquid for a colorant-receptive layer as used in Example 1 was coated on the primer layer at a coverage of 3 g/m$^2$ on a dry basis, and the coating was dried to form a colorant-receptive layer. The same coating liquid for an adhesive layer as used in Example 1 was then coated at a coverage of 4 g/m$^2$ on a dry basis on the polypropylene film in its side remote from the colorant-receptive layer, and the coating was dried to form an adhesive layer. The assembly was then applied to a coated paper (NK HI-KOTE, 127.9 g/m$^2$, manufactured by NIPPON KAKOH SEISHI CO., LTD.) as a support so that the adhesive layer faced the coated paper. Thereafter, a 15 μm-thick PEEC layer was stacked as a backside film on the coated paper (support) in its side remote from the colorant-receptive layer by extrusion coating of polyethylene resin. Thus, a thermal transfer image-receiving sheet of Comparative Example 1 was produced. In this case, a backside layer was formed on the backside film in its side remote from the support by coating the same coating liquid for a backside layer as used in Example 1 at a coverage on a dry basis of 2.5 g/m$^2$ and drying the coating.

Comparative Example 2

The procedure of Comparative Example 1 was repeated, except that, in the production of the thermal transfer image-receiving sheet, a 15 μm-thick PPEC layer was stacked as the backside film of the substrate by extrusion coating of polypropylene resin. Thus, a thermal transfer image-receiving sheet of Comparative Example 2 was produced.

Comparative Example 3

The procedure of Comparative Example 2 was repeated, except that, in the production of the thermal transfer image-receiving sheet, a 35 μm-thick PPEC layer was stacked as the backside film of the substrate by extrusion coating of polypropylene resin. Thus, a thermal transfer image-receiving sheet of Comparative Example 3 was produced.

Comparative Example 4

A primer layer (Unistole P801, manufactured by Mitsui Chemicals Inc.) was formed at a coverage of 1 g/m$^2$ on a dry basis on a 39 μm-thick polypropylene film (Toyopearl SS P 4255, manufactured by Toyobo Co., Ltd.) having in its inside microvoids. The same coating liquid for a colorant-receptive layer as used in Example 1 was coated on the primer layer at a coverage of 3 g/m$^2$ on a dry basis, and the coating was dried to form a colorant-receptive layer. The same coating liquid for an adhesive layer as used in Example 1 was then coated at a coverage of 4 g/m$^2$ on a dry basis on the polypropylene film in its side remote from the colorant-receptive layer, and the coating was dried to form an adhesive layer. The assembly was then applied to a coated paper (NK HI-KOTE, 127.9 g/m$^2$, manufactured by NIPPON KAKOH SEISHI CO., LTD.) as a support so that the adhesive layer faced the coated paper. Thereafter, the same coating liquid for an adhesive layer as used in Example 1 was coated at a coverage of 4 g/m$^2$ on a dry basis on the coated paper in its side remote from the colorant-receptive layer, and the coating was dried to form an adhesive layer. The coated paper was applied through this adhesive layer to a 39 $\mu$m-thick polypropylene film having in its inside microvoids (Toyopearl SS P 4255, manufactured by Toyobo Co., Ltd.) as a backside film. Thus, a thermal transfer image-receiving sheet of Comparative Example 4 was produced. In this case, the 40 $\mu$m-thick polyethylene film had a backside layer which had been previously formed by coating the same coating liquid for a backside layer as used in Example 1 at a coverage of 2.5 g/m$^2$ on a dry basis on the polyethylene film in its side remote from the adhesive layer and drying the coating.

Comparative Example 5

The procedure of Comparative Example 5 was repeated, except that, in the production of the thermal transfer image-receiving sheet, the backside film of the substrate was changed to a 25 $\mu$m-thick polypropylene film having in its inside microvoids (Toyopearl SS P 2101, manufactured by Toyobo Co., Ltd.). Thus, a thermal transfer image-receiving sheet of Comparative Example 5 was produced.

The thermal transfer image-receiving sheets prepared in the examples and the comparative examples were used to form images by thermal transfer under the following conditions. Specifically, a color image of a test pattern was formed, by means of a thermal transfer printer CP-7000 manufactured by Mitsubishi Electric Corporation, using a thermal transfer sheet having dye layers of three colors of yellow, magenta, and cyan in a face serial manner for CP-7000 manufactured by Mitsubishi Electric Corporation and each of the thermal transfer image-receiving sheets. In the above printer, the thermal transfer image-receiving sheet is carried while being held by a grip roller comprising a rubber roller and a metallic roller which has on its surface fine projections (spikes) formed by etching and carries the thermal transfer image-receiving sheet while allowing the spikes to bite into the thermal transfer image-receiving sheet.

The image-formed sheets prepared under the above conditions for image formation were evaluated for carriability by the following method.

Further, the thermal transfer image-receiving sheets prepared in the examples and the comparative examples were evaluated for anticurling properties by the following method.

Evaluation Methods

Carriability

In the image-formed sheet prepared under the above image formation conditions, the misregistration level of printed positions of magenta and cyan relative to the printed position of yellow was measured and evaluated by enlarging the print through a microscope.

Evaluation criteria are as follows.

○ (Good carriability): A misregistration level of less than 100 $\mu$m

Δ (Fair carriability): A misregistration level of 100 to less than 200 $\mu$m

X (Failed carriability): A misregistration level of not less than 200 $\mu$m

Anticurling Properties

The thermal transfer image-receiving sheets prepared in the examples and the comparative examples were cut into size A6. In this case, the cutting was carried out so that the long sides of size A6 were located in the flow direction of the continuous thermal transfer image-receiving sheet. The samples thus obtained were allowed to stand and stored under an environment of 0° C., under an environment of 25° C. and 80% RH, and under an environment of 40° C. and 90% RH for 4 days. One sheet of sample was put on a plane, and the height of curl was visually measured for four corners. The height average of data for the four corners was determined as the curl height.

Evaluation criteria are as follows.

○ (Good anticurling property): A curl height of less than 12 mm under each environment Δ (Fair anticurling property): A curl height of 12 to less than 15 mm X (Failed anticurling property): A curl height of not less than 15 mm The results of evaluation are shown in Table 1 below.

TABLE 1

| | Results of evaluation | |
|---|---|---|
| | Carriability | Anticurling property |
| Ex. 1 | ○ | ○ |
| Ex. 2 | ○ | ○ |
| Ex. 3 | ○ | ○ |
| Ex. 4 | ○ | Δ |
| Comp.Ex. 1 | X | Δ |
| Comp.Ex. 2 | ○ | X |
| Comp.Ex. 3 | ○ | X |
| Comp.Ex. 4 | X | ○ |
| Comp.Ex. 5 | X | X |

As described above, according to the present invention, in the thermal transfer image-receiving sheet comprising at least a colorant-receptive layer provided on a substrate, the substrate is formed of a laminate comprising a plastic film having at least in its inside microvoids, a support, and a backside film provided in that order from the colorant-receptive layer side and the backside film is an unstretched polyolefin film. By virtue of this construction, a thermal transfer image-receiving sheet can be realized which can be carried with improved accuracy within a printer, can form color images without misregistration, and does not permit traces of spikes to reach an image-receiving face and, thus, can minimize the influence of spikes on the quality of images.

What is claimed is:

1. A thermal transfer image-receiving sheet comprising:

a substrate; and a colorant-receptive layer provided on the substrate, said substrate being formed of a laminate comprising a plastic film having in its inside microvoids, a support, and a backside film provided in that order from the side of the interface with the colorant-receptive layer, said backside film being an unstretched polyolefin film.

2. The thermal transfer image-receiving sheet according to claim 1, wherein the backside film has a thickness of 12 to 40 $\mu$m.

3. The thermal transfer image-receiving sheet according to claim 1, wherein the backside film is formed of straight-chain low-density polyethylene.

4. The thermal transfer image-receiving sheet according to claim 1, which further comprises a polyolefin layer having a thickness of not less than 10 $\mu$m between the support and the backside film.

* * * * *